US011377845B2

(12) United States Patent
Ahmadi et al.

(10) Patent No.: US 11,377,845 B2
(45) Date of Patent: Jul. 5, 2022

(54) ACOUSTIC BAFFLE ASSEMBLY

(71) Applicant: USG Interiors, LLC, Chicago, IL (US)

(72) Inventors: Rana Ahmadi, Glendale, CA (US); Stephen Hettwer, Brea, CA (US)

(73) Assignee: USG INTERIORS, LLC, Chicago, IL (US)

( * ) Notice: Subject to any disclaimer, the term of this patent is extended or adjusted under 35 U.S.C. 154(b) by 192 days.

(21) Appl. No.: 16/849,175

(22) Filed: Apr. 15, 2020

(65) Prior Publication Data

US 2021/0324624 A1 Oct. 21, 2021

(51) Int. Cl.
*E04B 1/84* (2006.01)
*E04B 1/86* (2006.01)
*E04B 9/00* (2006.01)

(52) U.S. Cl.
CPC ..... *E04B 1/86* (2013.01); *E04B 9/001* (2013.01); *E04B 2001/8428* (2013.01); *E04B 2001/8452* (2013.01)

(58) Field of Classification Search
CPC .... E04B 1/86; E04B 9/001; E04B 2001/8428; E04B 2001/8452
USPC ..... 52/506.01
See application file for complete search history.

(56) References Cited

U.S. PATENT DOCUMENTS 8,733,053 B2 * 5/2014 Kabatsi ..... F16M 13/02 52/507
9,038,344 B2 * 5/2015 Mayer ..... E04B 9/245 52/506.05
9,163,402 B2 * 10/2015 Kabatsi ..... E04B 9/345
9,175,473 B2 * 11/2015 Kaump ..... E04B 9/127
D777,943 S * 1/2017 Kilian ..... D25/58
D777,944 S * 1/2017 Kilian ..... D25/58
D785,212 S * 4/2017 Kilian ..... D25/138
D794,223 S * 8/2017 Kilian ..... D25/138
11,199,002 B2 * 12/2021 Bou Harb ..... F21V 15/01
11,199,004 B2 * 12/2021 Headley ..... E04B 9/0407
2012/0285667 A1 * 11/2012 Maxik ..... H01L 33/648 165/121

(Continued)

FOREIGN PATENT DOCUMENTS

EP 0598980 A1 6/1994

OTHER PUBLICATIONS

Mdc Interior Solutions: "Zintra Acoustic Solutions", Aug. 15, 2019, pp. 1-116, XP055806078, New York, Retrieved from the Internet: URL:https://www.mdcwall.com/resources/pdf/Brochures/Zintra.pdf [retrieved on 2021-05-20] p. 62-p. 65.

(Continued)

*Primary Examiner* — Brian E Glessner
*Assistant Examiner* — James J Buckle, Jr.
(74) *Attorney, Agent, or Firm* — Pearne & Gordon LLP

(57) ABSTRACT

A circular multi-panel acoustic baffle assembly for suspending above an occupied space, the assembly including a plurality of baffle panel units each radiating away from a common center and generally lying in a vertical plane, upper edges of the baffle panel units lying in a common imaginary surface of revolution about the center, the baffle panel units being joined by common inner and outer arcuate ribs concentric with the center, radially inner ends and radially outer ends of the baffle panel units lying on imaginary circles concentric with the center.

11 Claims, 3 Drawing Sheets

(56) References Cited

U.S. PATENT DOCUMENTS

| | | | | |
|---|---|---|---|---|
| 2015/0068135 | A1* | 3/2015 | Waters | E04B 9/366 52/39 |
| 2016/0069076 | A1* | 3/2016 | Holdridge | E04B 9/10 52/712 |
| 2016/0245488 | A1* | 8/2016 | Clark | F21S 2/00 |
| 2018/0127976 | A1* | 5/2018 | Gillette | E04B 9/001 |
| 2018/0336875 | A1 | 11/2018 | Patterson et al. | |
| 2019/0338931 | A1* | 11/2019 | Ross | F21V 21/03 |
| 2020/0002942 | A1* | 1/2020 | Headley | E04B 9/0407 |
| 2021/0324627 | A1* | 10/2021 | Bixel | E04B 9/366 |
| 2021/0388614 | A1* | 12/2021 | Mosiadz | E04B 9/0428 |

OTHER PUBLICATIONS

Notification of Transmittal of The International Search Report and the Written Opinion, of the International Searching Authority, or the Declaration, International Search Report and Written Opinion of the International Searching Authority dated May 31, 2021 for PCT/US2021/023651.

* cited by examiner

ACOUSTIC BAFFLE ASSEMBLY

BACKGROUND OF THE INVENTION

The invention relates to suspended acoustic panel assemblies for reducing airborne noise.

PRIOR ART

In large occupied spaces, typically in commercial, industrial, or institutional buildings, acoustic baffles have been suspended from overhead structure.

The baffles are intended to minimize echo, reduce reverberation, and generally improve sound quality. Commonly, the baffles, which can be rigid or semi-rigid panels or draped fabric-like constructions are aligned in parallel or linear arrays.

There is a need for suspended acoustic baffle designs that depart from the traditional linear or rectangular layouts. Ideally, a design, if it is relatively large, should be capable of being made at a factory and shipped in parts, at reasonable cost, to the installation site.

SUMMARY OF THE INVENTION

The invention provides a cloud type circular acoustic baffle design or assembly that can be constructed in various sizes and can be fitted with acoustic panels of any color and any desired lower profile. The lower profiles of the acoustic panels collectively create the contour of the lower face of the assembly.

As disclosed, the baffle panels are arranged about a common center. The baffle panels are held together by circular ribs concentric with the enter. The ribs are relatively narrow in section and are disposed at upper edges of the baffle panels making them relatively inconspicuous when the assembly is suspended overhead. Moreover, the concentricity of the ribs, to the extent they are observed, visually reinforces the circular character of the baffle assembly.

Preferably, the baffle assembly is constructed of angular segments of a size that can be practically and conveniently shipped and that at the installation site can be easily combined into a circular assembly.

In the illustrated embodiment, the baffle panels are arranged in an annular pattern, leaving a central circular opening in which a lighting fixture, air duct or other device can be disposed and thereby visually integrated.

DESCRIPTION OF THE PREFERRED EMBODIMENTS

Figure 1:
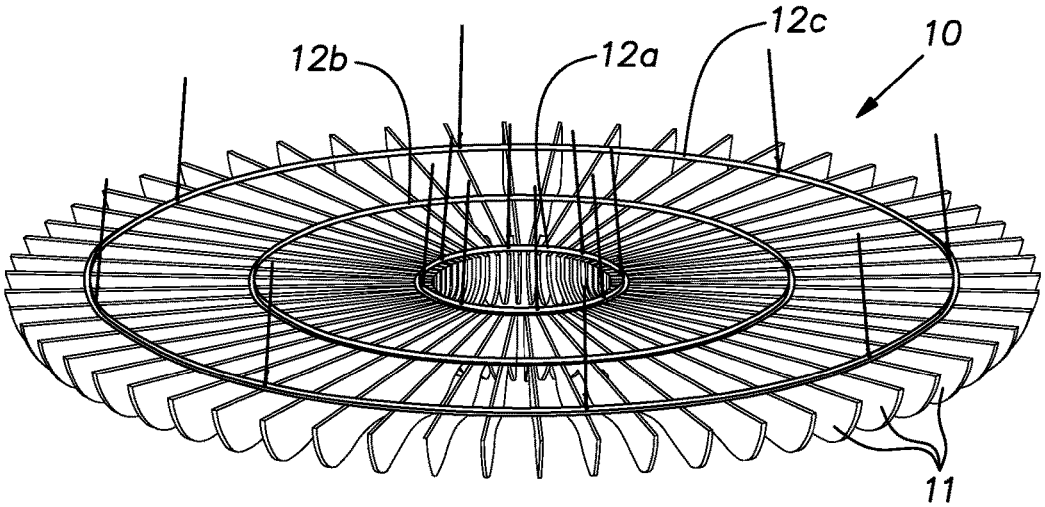
FIG. 1 is a perspective view of a first embodiment of the baffle assembly of the invention.

Referring to FIGS. 1-5, there is shown an acoustic baffle assembly 10 formed by a circular array of baffle panel units

11 held in place by annular ribs 12*a, b, c* (hereafter sometimes individually and/or collectively identified by the number 12). The baffle panel units 11, which can be identical, comprise a planar acoustic board 13 and an inverted metal channel 15 both being of generally equal length.

The board 13, for example, can be a PET felt acoustic panel marketed under the trademark COLORTEX™ of a nominal ½ inch thickness and rated at up to 0.85 NRC. A channel 15, made of 18 gauge steel for example, is assembled over an upper longitudinal edge of a respective board 13, preferably with a tight fit. Besides the tight fit, the board 13 and channel 15 can be fixed together by assembling mechanical fasteners such as binding barrel and screw sets through aligned holes in opposed holes in opposed legs of the channel 15 and the board 13 adjacent their longitudinal ends and mid-length. In normal installations, the baffle assembly 10 lies in a horizontal orientation or plane while the baffle panel units 11 lie in vertical planes.

Figure 2:
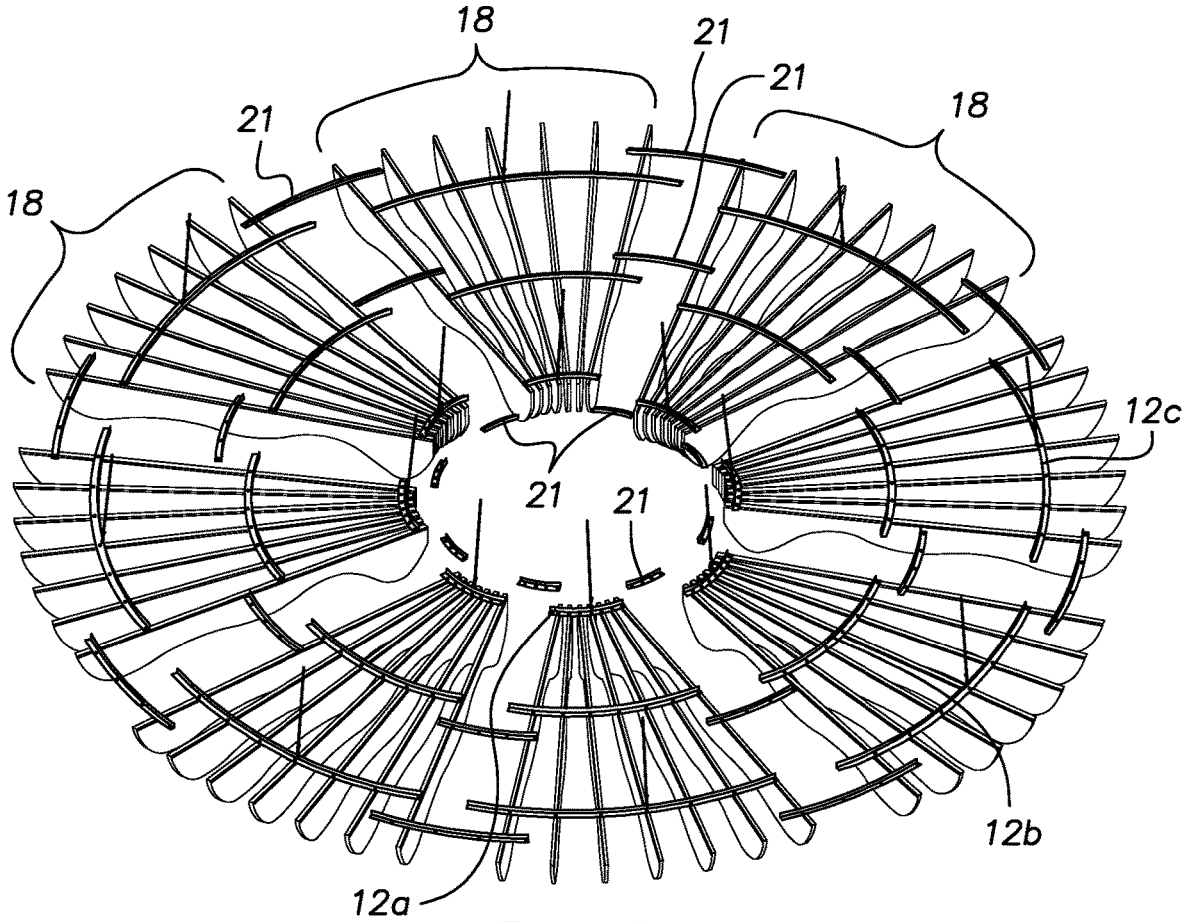
FIG. 2 is a radially exploded, perspective view of angular segments of the baffle assembly of FIG. 1.
Figure 3:
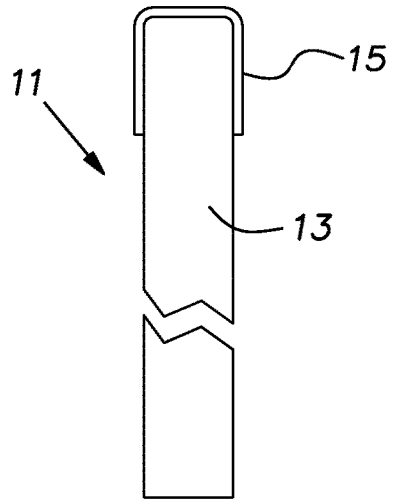
FIG. 3 is a cross-sectional view of a typical baffle unit.
Figure 4:
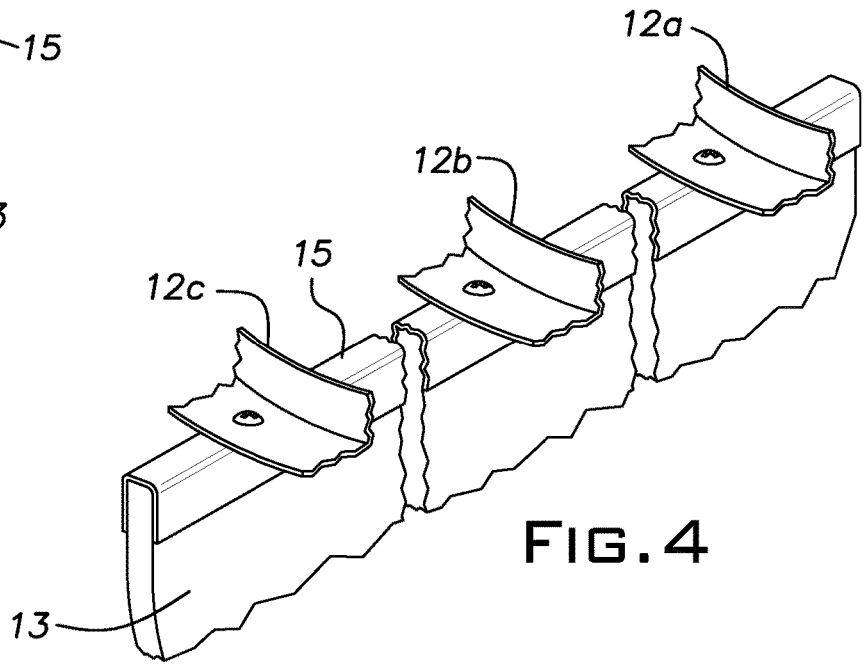
FIG. 4 is a fragmentary perspective view of a baffle unit and associated arcuate ribs.

The baffle panel units are fixed relative to one another by at least two annular ribs 12, depending on the outer diameter of the assembly 10. The baffle assembly 10 illustrated n FIGS. 1 and 2 is nominally 12 foot in outside diameter and has three annular ribs 12*a, b, c*. The ribs 12, preferably made of 18 gauge steel or other suitable metal or material, can have a right angle section with a vertical leg one-half the width of the horizontal leg.

Figure 5:
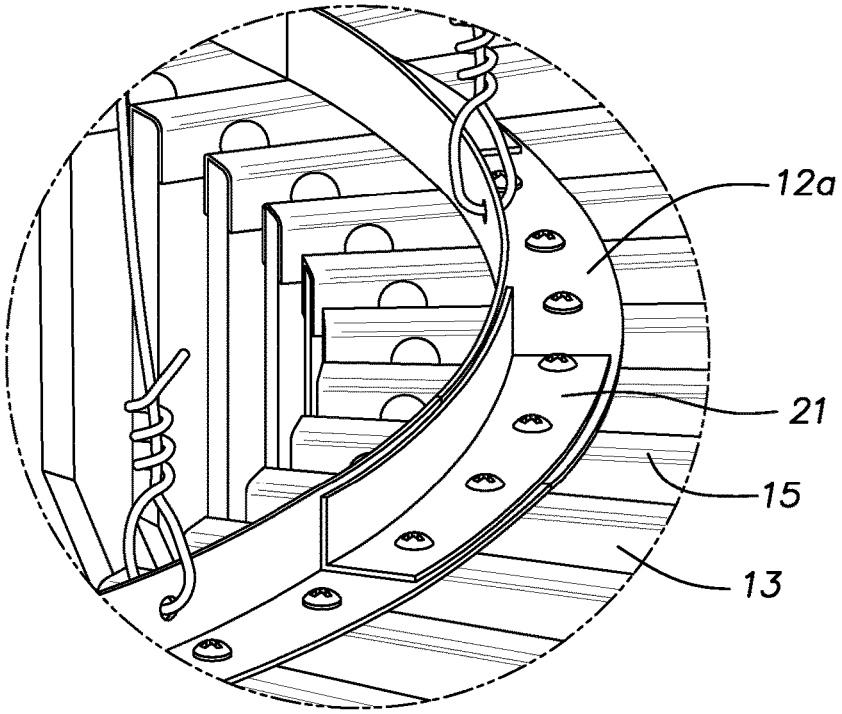
FIG. 5 is a fragmentary perspective view of a typical splice connecting adjacent angular baffle segments.

FIG. 5 illustrates a manner of fixing a rigid annular rib 12 to a baffle panel unit 11. Mechanical fasteners such as self-drilling sheet metal screws secure the horizontal leg of a rib 12 against a web of the channel 15 of each underlying baffle panel unit. The same fastening technique can be used to fix the other ribs 12*b, c* and panel units 11 in their desired relative positions.

As shown in FIG. 2, the baffle panel units 11 and arcuate sections of the ribs are assembled to form angular segments 18 of the circular baffle assembly 10. In the illustrated arrangement, ends of each rib section along one side of a segment 18 are cantilevered from the outlying baffle unit 11.

The baffle assembly segments 18 are fabricated by the manufacturer with a sufficiently small maximum width to be conveniently handled and packaged and economically shipped. At a site where the baffle assembly 10 is to be installed, the sections are joined by assembling arcuate splices 21 (shown in FIG. 5) over abutting ends of the rib sections. The shape of a splice 21, made from sheet metal like the ribs 12, preferably matches the radius and cross-section of a respective rib. The same fasteners can be used to attach the splices to the rib ends as those used to attach the rib ends to the baffle panel units. The various parts are configured so that when they are jointed, a central opening in the assembly 10 exists that can surround a light fixture, air duct or other device.

As shown in FIG. 5, the vertical legs of the ribs 12 have apertures for receiving suspension wires for suspending the assembly 10 from overhead structure. Alternatively, the splices or the ribs and splices can be apertured to provide reception points for suspension wires.

In the illustrated example, the lower longitudinally extending edges of the baffle boards are sculpted with the same curvilinear shape that collectively produces a three-dimensional contoured shape to the lower face of the assembly 10 that is visible to an observer below the assembly. Other edge profile arrangements are envisioned where, for example, the baffle board edges are angular or straight.

Figure 6:
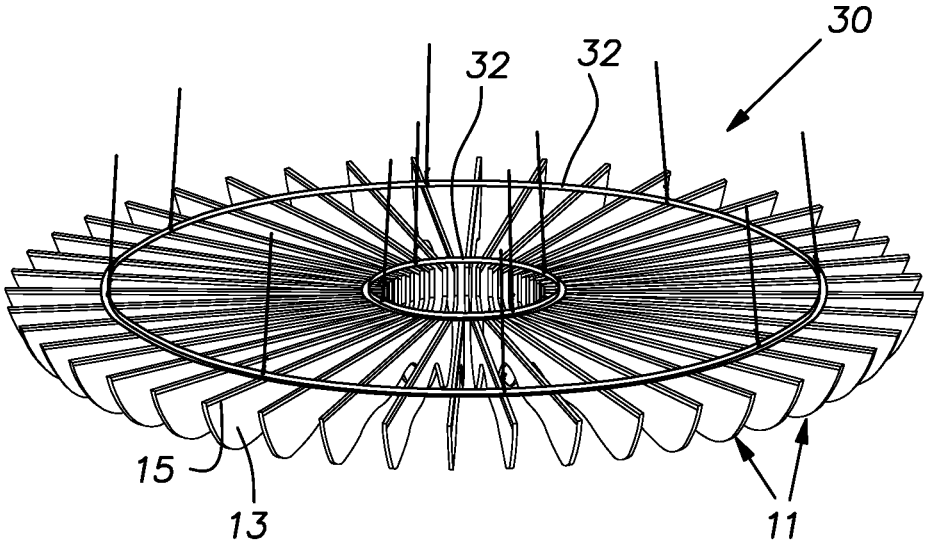
FIG. 6 is a perspective view of a second embodiment of a baffle assembly of the invention.
Figure 7:
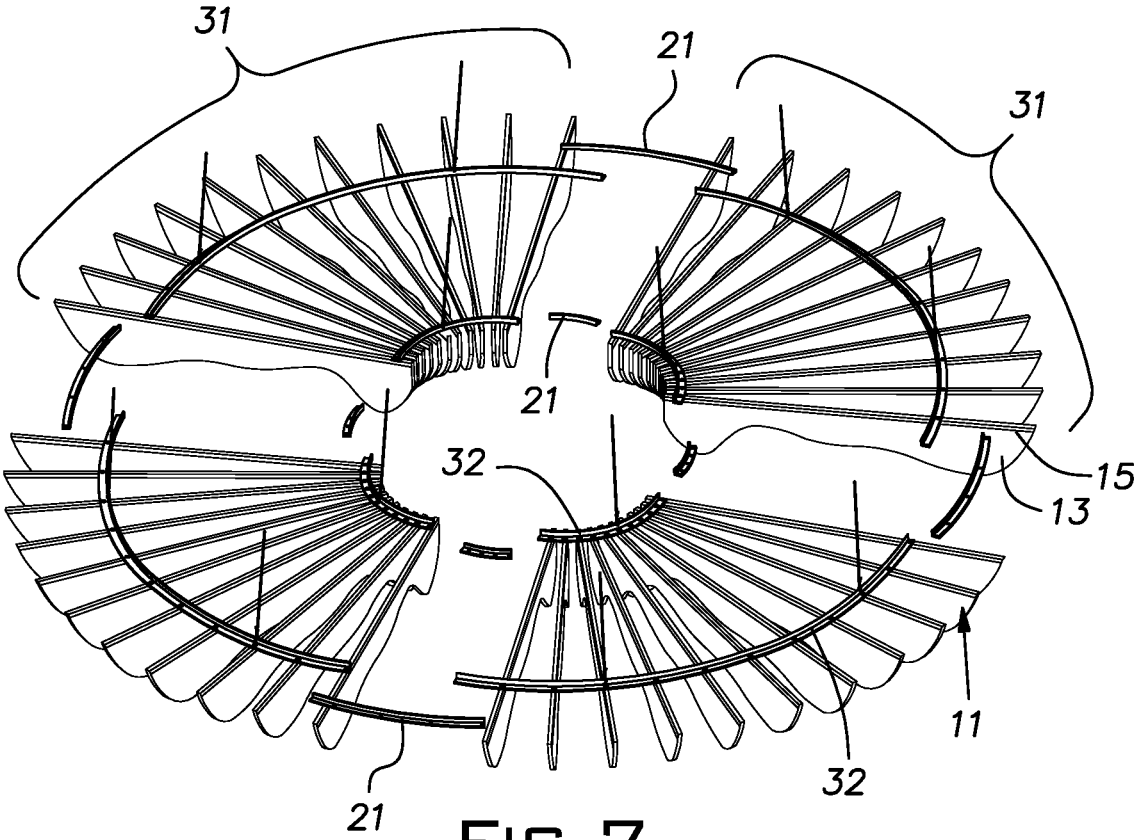
FIG. 7 is a radially exploded perspective view of angular segments of the baffle assembly of FIG. 6.

FIGS. 6 and 7 illustrate a second embodiment of the baffle assembly 30. The same numerals as previously used to designate parts of the first embodiment are used to designate the same or equivalent parts in this second embodiment. The baffle assembly 30 is smaller in outside diameter, being nominally 9 feet in diameter. The baffle assembly 30 differs from the first-described assembly 10 by having fewer angular segments 31 and fewer annular ribs 32. The construction, assembly, suspension and use of the baffle assembly is essentially the same as that described for the first baffle assembly 10.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention.

What is claimed is:

1. A circular multi-panel acoustic baffle assembly for suspending above an occupied space, the assembly including a plurality of baffle panel units each radiating away from a common center and generally lying in a vertical plane, upper edges of the baffle panel units lying in a common imaginary surface of revolution about the center, the baffle panel units being joined by common inner and outer arcuate ribs concentric with the center, radially inner ends and radially outer ends of the baffle panel units lying on imaginary circles concentric with the center, sections of the inner and outer arcuate ribs being fixed to a fraction of the total number of the baffle panel units to form an angular segment, the angular segments being arrangeable side-by-side to form an annular pattern, ends of said arcuate rib sections of one angular segment being joined to ends of said arcuate rib sections of an adjacent angular segment, said arcuate rib section ends being joined with arcuate splice elements, said arcuate rib sections and/or said splice elements having vertical legs.

2. The circular multi-panel acoustic baffle assembly as set forth in claim 1, wherein the inner and outer ribs are constructed and arranged to be supported by upwardly extending suspension wires.

3. The circular multi-panel acoustic baffle assembly as set forth in claim 1, wherein the radially inner ends of the baffle panel units are spaced from the center whereby they allow a fixture to be located at the center.

4. The circular multi-panel acoustic baffle assembly as set forth in claim 1, wherein said arcuate rib section ends and said splice elements have a right angle cross-section.

5. The circular multi-panel acoustic baffle assembly as set forth in claim 1, wherein said vertical legs have receptors to receive suspension wires.

6. The circular multi-panel acoustic baffle assembly as set forth in claim 5, wherein said receptors are apertures in said vertical legs.

7. The circular multi-panel acoustic baffle assembly as set forth in claim 1, wherein said baffle panel units include an acoustic fiber board.

8. The circular multi-panel acoustic baffle assembly as set forth in claim 7, wherein said baffle units include an inverted metal channel encasing an upper edge of said acoustic fiber board.

9. A kit for assembling a circular multi-panel acoustic baffle for suspension over an occupied space comprising a plurality of baffle panel units including an inverted metal channel encasing an upper edge of each of said plurality of baffle panel units, a plurality of arcuate ribs to be affixed to the metal channels of the baffle panel units to form angular segments, the angular segments being arrangeable side-by-side to form an annular pattern, ends of said arcuate rib sections of one angular segment to be joined to ends of said arcuate rib sections of an adjacent angular segment; arcuate splice elements having vertical legs to be joined with said arcuate rib section ends, said arcuate rib sections and said splice elements having vertical legs including apertures to receive suspension wires.

10. A kit as set forth in claim 9, including mechanical fasteners to join the splice elements to the angular segments.

11. A kit as set forth in claim 10, wherein the angular segments are constructed and arranged when joined side-by-side to form a central open space in which fixtures may be located.

* * * * *